United States Patent [19]

Tanaka

[11] Patent Number: 4,726,856

[45] **Date of Patent: * Feb. 23, 1988**

[54] METHOD FOR HEAT TREATING METAL PIPES

[75] Inventor: Atsushi Tanaka, Yokohama, Japan

[73] Assignee: Ishikawajima-Harima Jukogyo Kabushiki Kaisha, Japan

[ * ] Notice: The portion of the term of this patent subsequent to Aug. 26, 2003 has been disclaimed.

[21] Appl. No.: 764,171

[22] Filed: Aug. 9, 1985

[30] Foreign Application Priority Data

Nov. 14, 1984 [JP] Japan ..... 59-240241

[51] Int. Cl.[4] ..... C21D 1/00

[52] U.S. Cl. ..... 148/127; 148/136; 148/154

[58] Field of Search ..... 148/127, 13, 13.1, 14, 148/38, 136, 154, 150, 143

[56] References Cited

U.S. PATENT DOCUMENTS

| | | | |
|---|---|---|---|
| 2,876,226 | 1/1959 | Williams et al. | 266/131 |
| 4,168,190 | 9/1979 | Eguchi et al. | 148/136 |
| 4,229,235 | 10/1981 | Matsuda et al. | 148/127 |
| 4,395,022 | 7/1983 | Parlus et al. | 266/106 |
| 4,608,101 | 8/1986 | Umemoto | 148/127 |

*Primary Examiner*—Christopher W. Brody

[57] ABSTRACT

An effective method for heat treating metal pipe lines and especially a metal pipe line whose construction is so complicated as to tend to leave an air pocket therein.

2 Claims, 7 Drawing Figures

METHOD FOR HEAT TREATING METAL PIPES

BACKGROUND OF THE INVENTION

The present invention relates to a method for heat treating metal pipes.

It has been well known in the art that when tensile stresses and factors causing corrosion coexist in metal materials such as austenitic stainless steels widely used in nuclear power plants and other chemical plants, corrosion cracks are rapidly accelerated.

In order to improve stresses in such metal pipes, there has been devised and demonstrated a method in which while cooling water is forced to flow in a metal pipe, the metal pipe is subjected to induction heating so that the temperature difference between the outer and inner wall surfaces of the metal pipe causes thermal stresses in excess of a yield point, thereby causing residual compressive stresses in the inner wall surfaces adjacent to the welded joint between metal pipes.

The residual-stress-improvement method of the type described can be applied to metal pipes in simple shape such as straight pipes, but it has been difficult to apply this method to metal pipes in complicated shapes such as double pipes. Even when such method is applied to the residual-stress-improvement treatment of a double pipe, there arise some problems as will be described in detail below.

For instance, assume that a metal pipe 1 which is laid horizontally has a single pipe section 2 and a double pipe section 3 as shown in FIG. 1 and that a cylindrical space 7 ring-shaped in cross section has an enlarged-diameter portion 8 (See FIG. 2). Then even if cooling water is forced into the cylindrical space 7 in the direction as indicated by an arrow in FIG. 1, cooling water cannot completely fill the enlarged-diameter portion or pocket 8 so that a mass of air is left; that is, the so-called air pocket 9 is left in the enlarged-diameter portion 8. As a result, the cooling effect is reduced at the portions adjacent to the air pocket 9 so that the heat treatment conditions in the peripheral direction of the metal pipe 1 vary. As a consequence, there arises the problem that compressive stresses cannot be caused in a stable manner.

The present invention was made to overcome the above and other problems encountered in the conventional methods for heat treating metal pipes and has for its object to eliminate such air pocket as described above in a metal pipe line, thereby minimizing variations in residual stress improvement effects in the peripheral direction and improving reliability of the pipe line.

DETAILED DESCRIPTION OF THE PREFERRED EMBODIMENT

Figure 1:
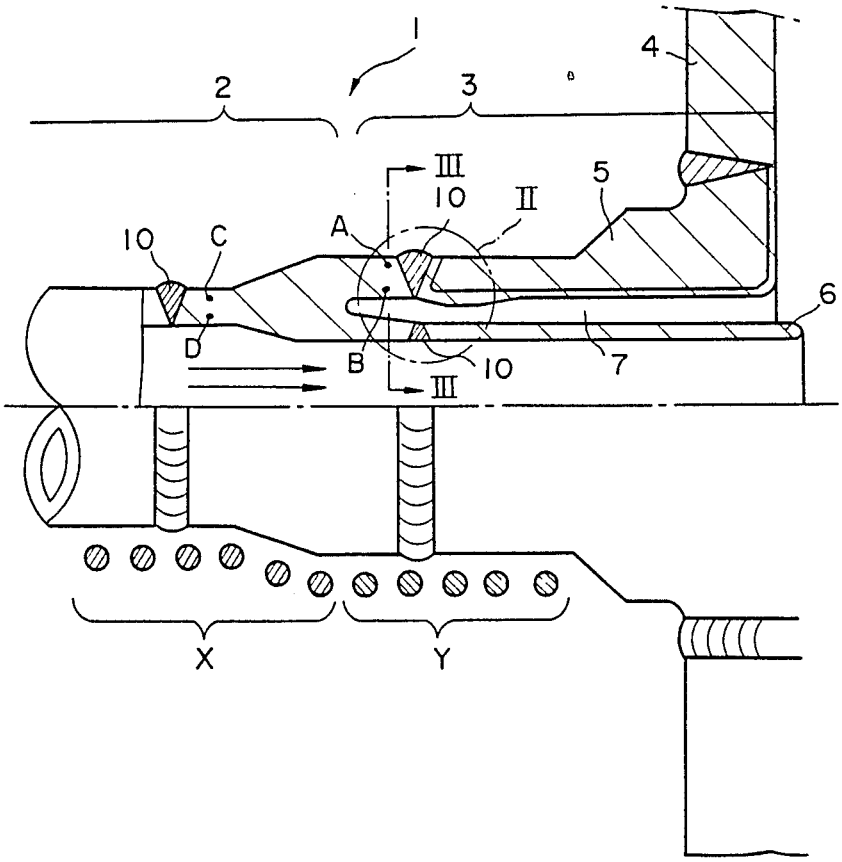
FIG. 1 is a fragmentary sectional view of a metal pipe line to which is applied a heat treatment method in accordance with the present invention.
Figure 2:
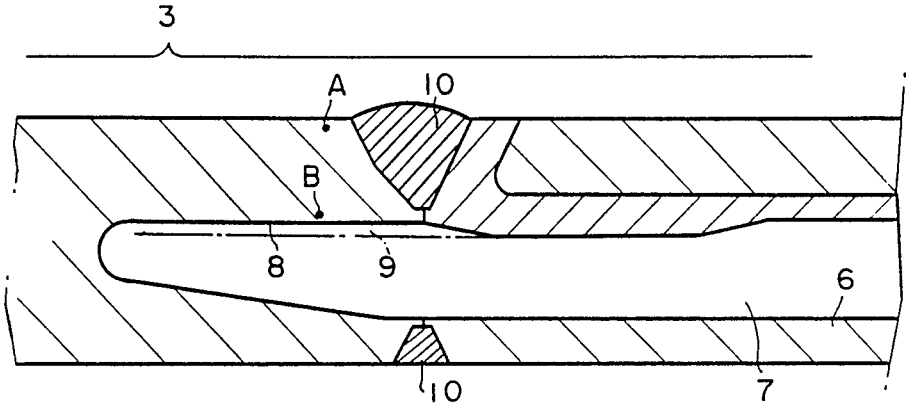
FIG. 2 is a partial view, on enlarged scale, of a portion encircled by a two-dot chain line II in FIG. 1.

In FIG. 1, the metal pipe line 1 is shown as consisting of the single pipe section 2 and the double pipe section 3 joined together in the horizontal direction. Such construction is used to provide a thermal sleeve 6 for a nozzle 5 of a pressure vessel 4 of a nuclear power plant. The horizontal fluid passage through the single pipe 2 is reduced in diameter at A in FIG. 1 and is joined to the thermal sleeve 6 and the cylindrical space 7 defined between the nozzle 5 and the thermal sleeve 6 is enlarged in diameter at B, whereby the enlarged diameter portion 8 is defined.

Cooling water is forced to flow in the direction indicated by the arrows in FIG. 1 so that dead water fills the cylindrical space 7 and the so-called air pocket 9 where air is trapped is left at the enlarged-diameter portion 8. According to the present invention, such air pocket 9 is eliminated when the residual-stress-improvement treatment is carried out.

Figure 3:
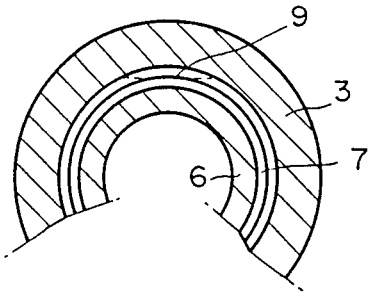
FIG. 3 is a cross sectional view taken along the line III—III of FIG. 1.
Figure 4:
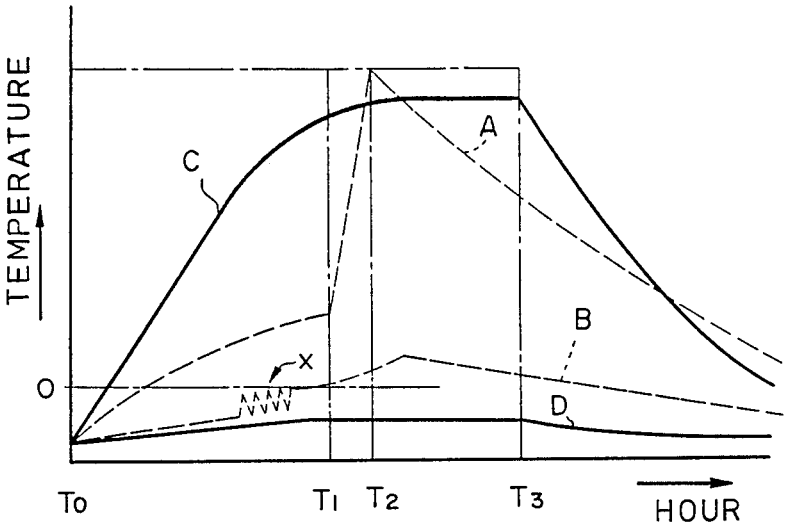
FIG. 4 shows a relationship between the temperature and the heat treatment time in hour at each of model or sampling points A–D shown in FIG. 1.

According to the present invention, an induction heating coil X is used to heat the single-wall pipe section 2 so that the temperature of the pipe walls adjacent to a welded joint 10 is raised as shown in FIG. 4 from time $T_0$ to time $T_1$. In this case, heat is transferred from the single-wall pipe section 2 to the double-wall pipe section 3 so that the latter is also heated. Dead water remains in the cylindrical space 7 so that the temperature at the model or sampling point B becomes higher than that at the model or sampling point D. When the temperature at the model or sampling point B reaches at a level at which nucleate boiling occurs at the inner wall surface of the double-wall pipe section 3, steam thus produced as well as air in the air pocket 9 are gradually discharged. While nucleate boiling continues, the temperature of the portion adjacent to the air pocket 9 becomes lower temporarily than the temperature at the other portions in the peripheral direction (See FIG. 3) because of heat of evaporation. As air is discharged, water intrudes into the air pocket 9 so that the whole peripheral inner wall surface of the enlarged-diameter portion 8 is made into contact with cooling water so that film boiling results. However, if the temperature at the model or sampling point B is less than a temperature (for example, about 130° C. at 3 kgf/cm$^2$) at which nucleate boiling occurs, the auxililary heating is carried out by energizng an induction heating coil Y shown in FIG. 1 as described above. The temperature rise and drop at each model or sampling point A, B, C or D is indicated by the curve A, B, C or D in FIG. 4. When film boiling occurs in the enlarged-diameter portion 8, the air pocket 9 is eliminated so that a temperature distribution becomes substantially uniform in the peripheral direction. Therefore, a nucleate boiling temperature is used as a reference to produce a temperature difference between the outer and inner wall surfaces adjacent to the welded joint 10 (that is, between the model or sampling points C and D). (In this case, in addition to the induction heating, the induction heating coil Y may be used as an auxiliary means.) The temperature difference is within a range lower than a transformation temperature and within a range in which thermal stresses are caused in excess of yield points in various directions in the pipe wall. The heating time $T_1$ required for bringing a temperature into the steady state is obtained by the following equation:

$$T_1 \geqq 0.7\,(L_1)^2/a \quad (1)$$

where $L_1$ = the maximum wall thickness, and a = a temperature diffusion coefficient.

Figure 5:
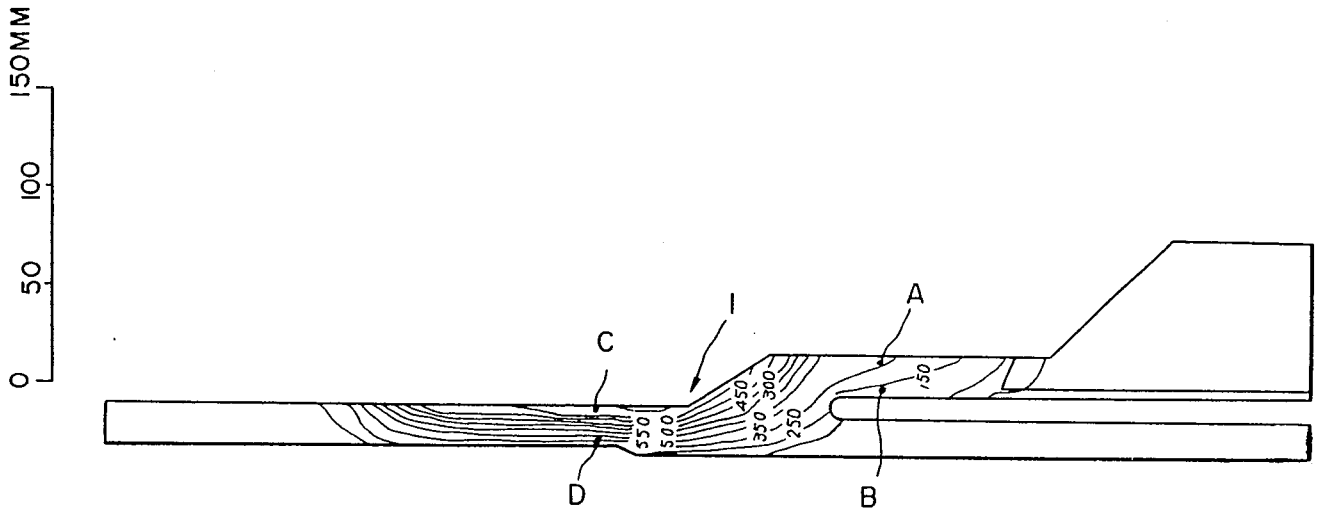
FIG. 5 shows a temperature distribution of the pipe line at $T_1$ shown in FIG. 4.

FIG. 5 shows a temperature distribution of the metal pipe line 1 at $T_1$. For instance, the temperatures at the model or sampling points C and D are 550° C. and 200° C., respectively, so that their difference is higher than a temperature difference (in excess of 200° C. in the case of an austenitic stainless steel) which is sufficiently high enough to cause thermal stresses in excess of a yield point.

Whether or not the poriton adjacent to the model or sampling point B is in the film boiling state can be detected by the fact that there is no severe temperature variation due to the replacement of the remaining air and steam produced as indicated by the arrow x on the curve B in FIG. 4 or by detecting whether or not a film boilng temperature is reached. In this case, it is difficult to insert a thermometer into the enlarged-diameter poriton 8. Therefore, it is effective to detect the variation in curve B in FIG. 4 at time $T_1$ or at a time prior to $T_1$ by comparing the variation in surface temperature at the model or sampling point A when the metal pipe line 1 is heated while the air pocket 9 remains with the temperature variation at the same point when the metal pipe line 1 is heated under the same conditions after the remaining air has been discharged and obtaining a temperature diffence therebetween so as to use as a reference Thereafter, while the single-wall pipe section 2 is induction heated by the coil x, the double-wall pipe section 3 is induction heated by the coil Y so that the pipe line 1 is heated by both the induction heating coils X and Y and the temperature differences as shown at $T_1$ and $T_2$ in FIG. 4 are produced between the nozzle 5 and the pipe wall adjacent to the welded join 10 (between the model or sampling points A and B). In this case, the heating time $T_2-T_1$ can be obtained by the following equation:

$$T_2-T_1\,(0.05\sim0.2)\,(L_2)^2/a \quad (2)$$

where $L_2$ = the wall thickness of a pipe.

Figure 6:
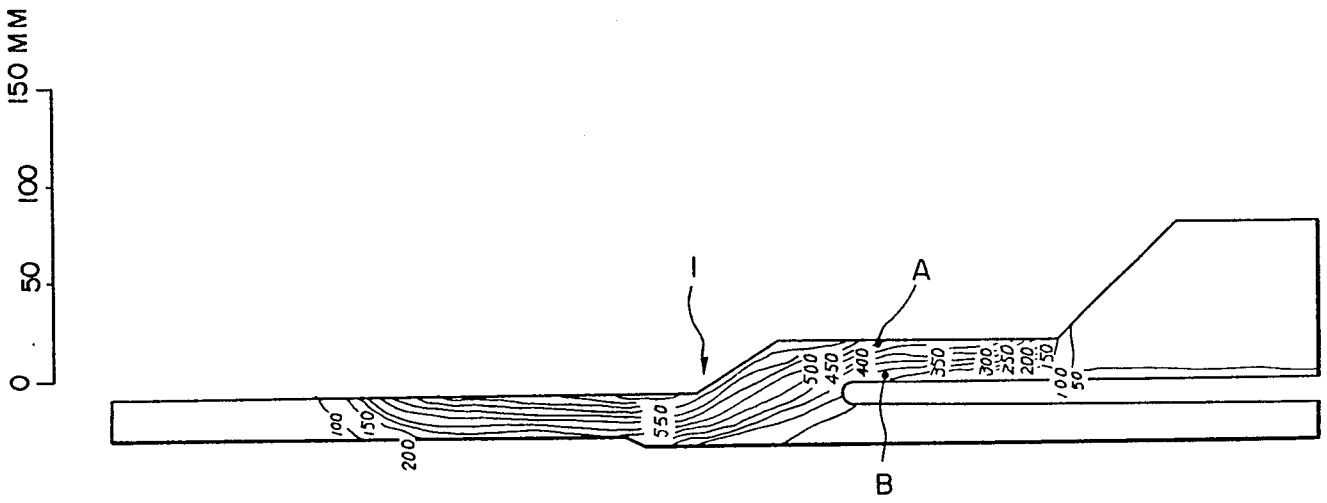
FIG. 6 shows a temperature distribution of the pipe line at $T_2$ shown in FIG. 4.

The heating time $(T_2-T_1)$ is short so that the so-called super-accelerating-heating is effected. FIG. 6 shows a temperature distribution in the pipe wall of the metal pipe line 1 at time $T_2$. For instance, the temperatures at the model or sampling points A and B are 450° C. and 180° C., respectively, and the temperature difference between the model or sampling points A and B is sufficient enough to cause thermal stresses in excess of a yield point. Furthermore, a substantially uniform temperature distribution can be established in the direction of thickness over the whole heated portion of the metal pipe line as shown in FIG. 6.

Thereafter the metal pipe line 1 is cooled at a substantially uniform rate. Then residual compressive stresses would be caused in the portions in contact with cooling water. However, in the case of the metal pipe line 1 shown in FIG. 1, there exists a large difference in cooling capacity between the flowing cooling water and the dead water so that when heating is stopped simultaneously, the portion in contact with the flowing cooling water is first cooled and, for instance, the model or sampling points A and B of the double-wall pipe section 3 remain as so-called hot spots. As a result, the residual-stress-improvement is degraded. Therefore, the induction heating by means of the induction heating coil Y is stopped and the cooling of the double-wall pipe section 3 is started first as indicated at $T_2$ or $T_3$ in FIG. 4. In this case, the time $(T_3-T_2)$ required for cooling is generally obtained by the following relation:

$$T_3-T_2 \cong (L_2)^2/a \quad (3)$$

Figure 7:
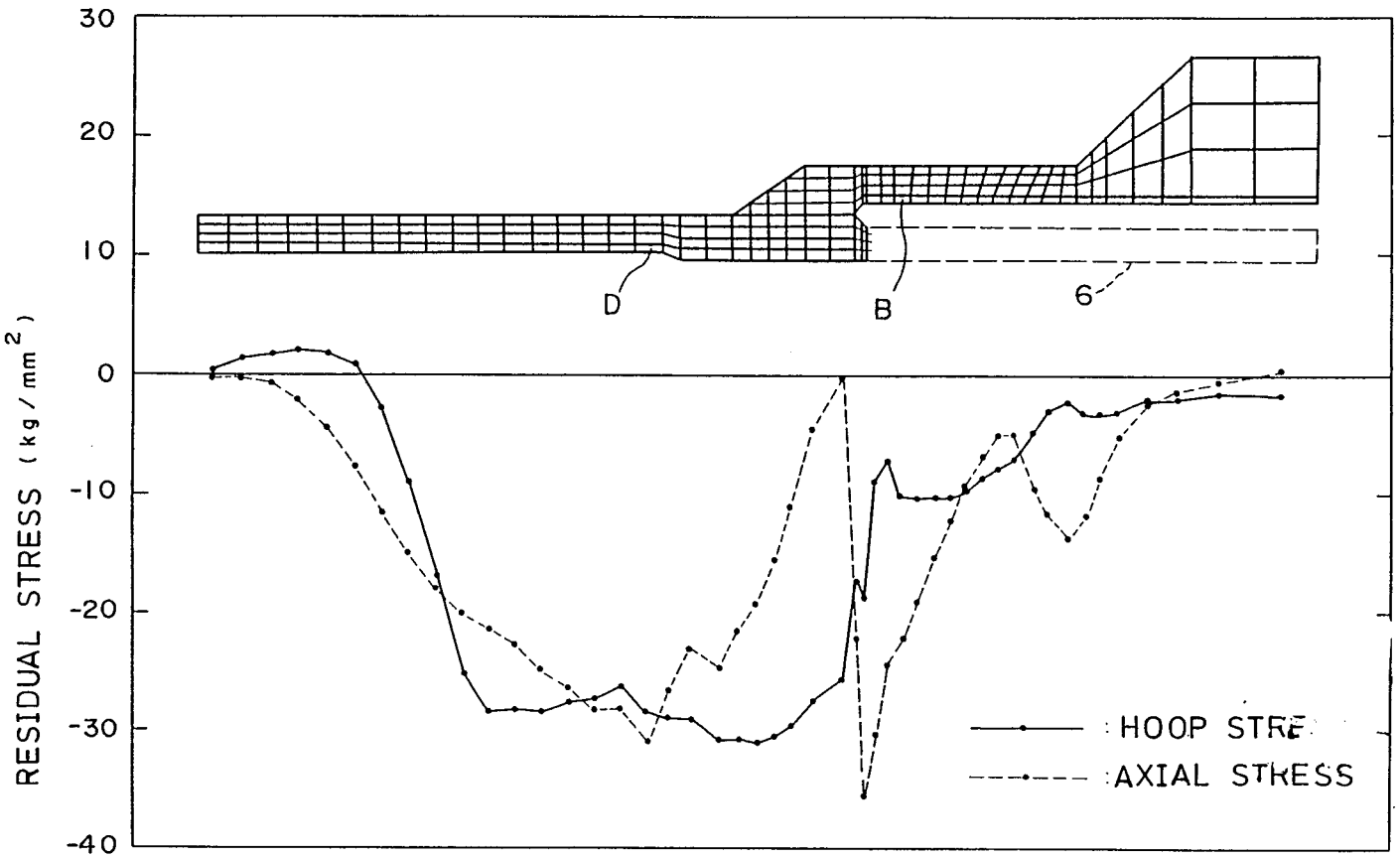
FIG. 7 shows residual stresses caused in the metal pipe line after it was cooled as shown in FIG. 4.

When the induction heating coil X is de-energized at $T_3$ under these conditions and the cooling is started, the residual compressive stresses are caused as shown in FIG. 7. More particularly, the residual stresses caused in the inner wall surfaces of the metal pipe line 1 except the thermal sleeve 6 consist of hoop stresses (solid lines) in the peripheral direction and the axial stresses (the broken lines) in the axial direction. Especially at the portion adjacent to the welded joint such as the model or sampling point B where stresses are desired to be improved and where an air pocket tends to be left, even when the residual compressive stresses are caused and even when a fluid flowing through the metal pipe line 1 includes compounds tending to cause corrosion, cracks due to the corrosive compounds can be inhibited. Furthermore, even when there do exist some corrosion cracks prior to the heat treatment is carried out, propagation of cracks can be prevented. Mesh-like divited portions in FIG. 7 show limited elements for obtaining residual stresses and the intersection between a vertical line drawn from a given limited element at the inner surface of the metal pipe line 1 and a curve indicates a corresponding magnitude of residual stress.

For the heat treatment method of the present invention has been described in detail in conjunction with the metal pipe line as shown in FIG. 1, but it is to be understood that the present invention may be equally applied to a pipe assembly or line laid in any desired direction. For instance, the heat treatment method of the present invention can be advantageously applied to a single wall pipe line in which an air pocket or dead water tends to be left.

The effect, features and advantages of the present invention may be summarized as follows:

(a) Even when a pipe line is laid horizontally so that dead water tends to be left therein or even when component parts of a pipe line are so designed and assembled that an air pocket tends to be left in an assembled pipe line, the residual-stress-improvement of the inner wall surfaces of the pipe line can be carried out so that corrosion cracks can be inhibited and prevented.

(b) An air pocket can be liminated while the heat treatment is being carried out so that variations in improvement of residual stresses in the peripheral direction of a metal pipe line can be reduced to a minimun so that reliability of the pipe line can be remarkably improved.

(c) Even when the shape of assembled pipe line component parts is complicated, the residual-stress improvement can be carried out by effecting the induction heating of individual parts not simultaneously but one after another leaving a predetermined time interval. Furthermore the heat treatment method of the present invention can be easily applied to various pipe lines.

What is claimed is:

1. A method for heat treating a metal pipe line comprising the steps of heating the metal pipe line while leaving cooling water in and adjacent to an enlarged-diameter portion of the metal pipe line; causing nucleate boiling and film boiling in said enlarged-diameter portion, thereby discharging air entrapped therein; and effecting the heat treatment of the pipe walls adjacent to the enlarged-diameter portion by utilizing the temperature difference between said film boiling temperature and the temperature at the outer wall surface of the pipes.

2. A method for heat treating a metal pipe line comprising the steps of heating the metal pipe line while leaving cooling water in and adjacent to an enlarged-diameter portion of a double walled pipe section located adjacent a single wall pipe section; causing nucleate boiling and film boiling in said enlarged-diameter portion, thereby discharging the air entrapped therein; heating said single wall pipe to produce a temperature difference between the outer and inner wall surface of said single wall pipe adjacent to said enlarged-diameter portion so that the thermal stresses in excess of a yield point are caused; thereafter heating for a short period of time so that thermal stresses in excess of a yield point are caused in the outer and inner surfaces of said double walled pipe section; and interrupting the heating of said single wall pipe section after a predetermined time interval.

* * * * *

UNITED STATES PATENT AND TRADEMARK OFFICE

CERTIFICATE OF CORRECTION

PATENT NO. : 4,726,856

DATED : Feb. 23, 1988

INVENTOR(S) : Atsushi Tanaka

It is certified that error appears in the above-identified patent and that said Letters Patent is hereby corrected as shown below:

Column 3, line 45, after that portion of equation (2) reading $T_2 - T_1$ should be inserted $\geq$ Signed and Sealed this Twenty-sixth Day of September, 1989

*Attest:*

DONALD J. QUIGG

*Attesting Officer*

*Commissioner of Patents and Trademarks*